US005382802A

United States Patent [19]

Anabuki et al.

[11] Patent Number: 5,382,802

[45] Date of Patent: Jan. 17, 1995

[54] METHOD OF IRRADIATING RUNNING STRIP WITH ENERGY BEAMS

[75] Inventors: Yoshinori Anabuki; Eiji Hina, both of Okayama, Japan

[73] Assignee: Kawasaki Steel Corporation, Japan

[21] Appl. No.: 109,180

[22] Filed: Aug. 19, 1993

[30] Foreign Application Priority Data

Aug. 20, 1992 [JP] Japan ..... 4-221499

[51] Int. Cl.[6] ..... B41L 3/02

[52] U.S. Cl. ..... 250/492.1; 250/492.3; 250/400; 250/548; 219/121.83

[58] Field of Search ..... 250/492.1, 492.3, 398, 250/400, 548, 571, 572; 219/121.68, 121.69, 121.72, 121.83, 121.26

[56] References Cited

U.S. PATENT DOCUMENTS 3,683,179 8/1972 Norman ..... 250/492.1

*Primary Examiner*—Paul M. Dzierzynski
*Assistant Examiner*—Kiet T. Nguyen
*Attorney, Agent, or Firm*—Austin R. Miller

[57] ABSTRACT

A method of irradiating a continuously-running strip with energy beams. Scanning the width of continuously-running strip positions energy-beam irradiating devices along the width of the strip. Allocation of scanning regions along the width of the strip corresponding to respective energy-beam irradiating devices is determined. When an edge deviation or strip wind is detected by a strip-edge detector upstream of the energy-beam irradiating devices, the strip regions to be scanned are adjusted. If the amount of strip wind exceeds the limits of the scannable energy-beam irradiating devices, neighboring irradiating devices are re-oriented, all in response to upstream strip wind detection.

4 Claims, 6 Drawing Sheets

CONVENTIONAL

CONVENTIONAL

CONVENTIONAL

METHOD OF IRRADIATING RUNNING STRIP WITH ENERGY BEAMS

BACKGROUND OF THE INVENTION

1. Field of the Invention

The present invention relates to a method of irradiating a running steel or other strip with energy beams. Energy-beam irradiation is performed by utilizing a plurality of individually located and oriented energy-beam irradiating devices and can be performed along the width of the strip even when an edge deviation or so-called "strip wind" occurs on the strip.

In accordance with the present invention, the strips used include not only metal strips such as cold-rolled steel sheet and aluminum sheet, but also various non-metal strips which are capable of running continuously along a production line.

The applied energy beam may include any irradiation beam emitted from plural energy sources using any of a variety of beam-like irradiations, such as electron beams, laser beams, plasma beams, or the like.

2. Description of the Related Art

Treatments for improving physical, chemical and surface characteristics of various strips or sheets are widely performed in various fields. For example, metallurgical, thermal and chemical treatments and the like are performed by irradiating strips or sheets with one or more of various energy beams.

In order to carry out these irradiations industrially, methods are available such as irradiating a running strip with a flat beam or a plurality of beams so as to cover the overall width of the strip, or the use of scanning beams arranged along the width of the strip.

The latter method is often used when the beam-generating device is expensive, when irradiation is performed with a view to improving the beam-focusing rate, or when the surface of the strip is intended to be irradiated with a plurality of different linear beams in order to finely divide the magnetic domain of a silicon steel sheet, for example, as disclosed in Japanese Patent Publication No. 2-40724, Japanese Patent Laid-Open No. 1-281708, or the like.

When energy-beam irradiation treatment of such a scanning type is applied to a wide strip running at a predetermined speed, such as a cold-rolling steel sheet, a plurality of individual energy-beam irradiating devices may be used according to the width of the strip.

Known energy-beam irradiation will now be described by way of an example using an electron-beam device as an energy-beam irradiating device.

FIGS. 1 and 2 of the drawings indicate a conventional method of uniformly scanning electron beams along the width of a strip by utilizing a plurality of electron-beam irradiating devices.

Although five electron-beam irradiating devices are shown as placed along the width of the strip in this example, two or more irradiating devices, or some other number, may be used.

FIGS. 1 and 2 indicate respectively electron-beam irradiating devices 1–5, an electron-beam controller 6 and a strip driving controller 7.

The strip irradiating beams are applied from the devices 1–5 in accordance with the width (W) obtained by taking the amount of linear deviation or strip winding into account, in addition to the width of the strip. According to a signal from the electron-beam controller 6, electron beams can be scanned along the width of the strip. The effective electron-beam irradiating device is selected with respect to the width W as follows (FIG. 1).

where $W \leqq W_1$: Device 3 only where $W_1 \leqq W \leqq W_2$: Devices 2–4 where $W_2 \leqq W \leqq W_3$: Devices 1–5 where $W_1$ shows the scannable width when only the electron-beam irradiating device 3 is desired to be used; $W_2$ indicates the scannable width when the electron-beam irradiating devices 2–4 are desired to be used; and $W_3$ represents the scannable width when all of the electron-beam irradiating devices 1–5 are desired to be used.

The irradiation con, and signal from controller 6 is controlled by the strip driving controller 7, taking the strip running speed into consideration. Further, the electron-beam irradiating regions are determined in real time, and the respective electron-beam scannings by the electron-beam irradiating devices 1–5 are constantly parallel to each other at a fixed pitch.

In the above conventional operation, since the actual amount of lateral deviation or winding of the strip is not taken into account, irradiation is performed within the regions of the scannable maximum values $W_1$–$W_3$ of the selected electron-beam irradiating device.

These conventional methods of scanning electron beams by utilizing a plurality of electron-beam irradiating devices encounter important problems.

When a band-like strip is run continuously, it has been found that some amount of out-of-plane deformation of the sheet referred to as strip winding is caused by the conveying system, and cannot be avoided.

When the strip is run at a relatively low speed, the edge of the strip is clamped by a guide roller or the like, thereby inhibiting such strip winding. On the other hand, however, when the strip is run at a relatively high speed, considerable forces act upon the sheet, thus causing distortion or deformation. In such a case, the edge of the sheet simply cannot be clamped in place as a practical matter.

Instead, a so-called steering device has been tried to put a strip in the center of the line without touching the edge. However, even a high-cost and high-performance steering device cannot totally avoid sheet winding due to limited response and other causes. Further, when the strip itself possesses camber, the occurrence of strip winding is effectively unavoidable while continuously running.

In particular, when the electron-beam irradiating devices are longitudinally positioned in the machine direction to form steps, non-irradiated beam portions or overlapping-irradiated beam portions are produced in the vicinities of the borders between the neighboring irradiated regions on the strip, thus causing serious strip quality problems.

An electron-beam irradiating device requires very substantial peripheral space because of a vacuum system associated with it. Also, economical high-speed treatment of strip requires high energy density, and accordingly, the width scanned by one electron gun must be rather narrow.

Thus, electron-beam irradiating devices of the type described are normally longitudinally displaced along the machine direction to form steps in the high-speed treatment lines normally used.

As shown in FIG. 3, the electron-beam irradiating devices 1–5 are displaced to form steps along the strip running direction so that each irradiating device is displaced by the distance K. In this condition, when a strip wind shifts toward the "+" direction (toward the right in the drawing) such as to provide an amount of strip wind G within a distance M obtained by running the strip from the strip wind start point to the end point, non-scanned-omitted portions $V_1$–$V_4$ are unavoidably produced due to the distance K, the displacement of the two neighboring irradiating devices.

In the stepped electron-beam irradiating devices of FIG. 3, when a strip wind shifts toward the "−" direction (toward the left in the drawing), the strip is scanned with overlapping.

A further problem occurs in irradiating edge regions. An electron-beam irradiating device is selected with the maximum width of a steel strip in mind, and irradiating as nearly as possible within the scannable maximum width. Hence, as shown in FIG. 2, the portions of the apparatus, for example, the strip support roll or the wall within the vacuum chamber, is repeatedly or continuously irradiated, seriously deteriorating these components and causing major problems of equipment maintenance.

In order to overcome the above problems, a beam-shielding cover is suggested, for example, in Japanese Patent Laid-Open No. 58-181820 However, such a shielding cover is not complete and the usage of high-energy beams requires a cooling unit, disadvantageously enlarging the device even more.

Further, when the amount of strip wind is unexpectedly increased, and consequently, the edge regions of the strip fall outside the scannable width of the pre-positioned electron-beam irradiating devices. The non-irradiated portions are produced at the edge of the strip, thus further causing serious problems in terms of the quality of the strip. The electron-beam devices cannot be modified easily.

Though irradiation has been described by using electron beams as energy beams, the application of laser beams or plasma beams also creates similar problems.

OBJECTS OF THE INVENTION

Accordingly, it is an object of this invention to overcome the difficulties just described. Another object of the present invention is to provide a method of irradiating strip with energy beams, even when strip winds are present, and to cause the regions scanned by respective energy-beam irradiating devices and the energy-beam irradiating devices to be quickly modified in accordance with the actual amount of strip wind, thereby effectively preventing the disadvantageous production of unwanted beam non-irradiated portions and overlapping-irradiated portions, and also preventing damaging beam irradiation on any area other than the strip, thus achieving stably uniform irradiation all along the desired portions of the width of the strip.

SUMMARY OF THE INVENTION

In order to achieve the above objects, according to one embodiment of the present invention, a continuously-running strip is irradiated with energy beams achieved by scanning and tracking along the width of the continuously-running strip by utilizing a plurality of energy-beam irradiating devices installed along the width of the strip. This can remarkably be achieved by sensing in advance the allocation of scanning regions along the width of the strip to the respective energy-beam irradiating devices and quickly adjusting the regions in response to a strip wind. This can conveniently be achieved by strategic and advantageous location of a strip-edge detecting device placed closer to the upstream line than the energy-beam irradiating devices, in accordance with the detected amount of the strip wind, thereby constantly and in advance scanning the predetermined regions on the strip by the allocated energy-beam irradiating devices.

According to another embodiment of the present invention, a continuously-running strip is irradiated with energy beams by scanning along the width of the strip on the continuously-running strip by utilizing a plurality of additional neighboring energy-beam irradiating devices installed along the width of the strip. This may be achieved by sensing or determining in advance the allocation of scanning regions along the width of the strip to the respective energy-beam irradiating devices; shifting from the respective energy-beam irradiating devices for scanning the predetermined regions to the neighboring devices adjacent to a strip wind when the amount of strip wind detected by the strip-edge detecting device exceeds the scannable regions by the energy-beam irradiating devices; and scanning the regions by the shifted energy-beam irradiating devices.

According to still an other embodiment of the present invention, a plurality of energy-beam irradiating devices may be installed to form steps arranged to cross the strip obliquely longitudinally.

In accordance with the present invention, the strip-edge detecting device, which may be referred to as an edge sensor, is placed upstream of the energy-beam irradiating devices, thereby detecting deviations of the aforementioned edge regions in real time. Also, the allocated regions scanned by the main energy-beam irradiating devices are changed by angular beam adjustment in response to the sensing of the edge sensor, thus enabling energy-beam scanning in accordance with the amount of the strip wind. As a result, non-irradiated portions or overlapping-irradiated portions on the strip are effectively eliminated, significantly improving the quality of the product and its yield.

Further, in regard to the irradiation of the edge regions, the strip, except for a small amount of non-irradiated regions at the strip edges, can be scanned, thus effectively preventing leakage of irradiating beams on any area other than the strip and remarkably reducing the manpower required to maintain equipment such as a vacuum chamber, a strip support roll, or the like.

Figure 1:
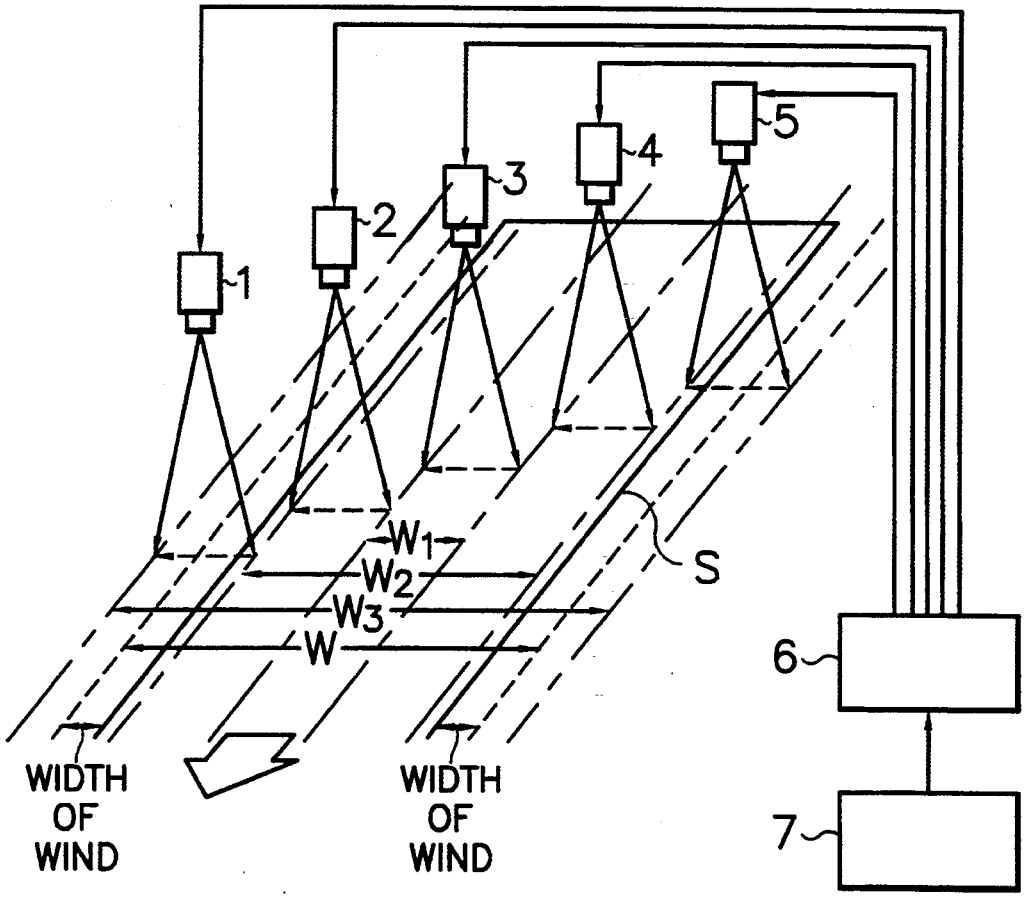
Fig. 1 PRIOR ART
FIG. 1 shows typical electron-beam scanning according to a conventional method by utilizing a plurality of electron-beam irradiating devices.
Figure 2:
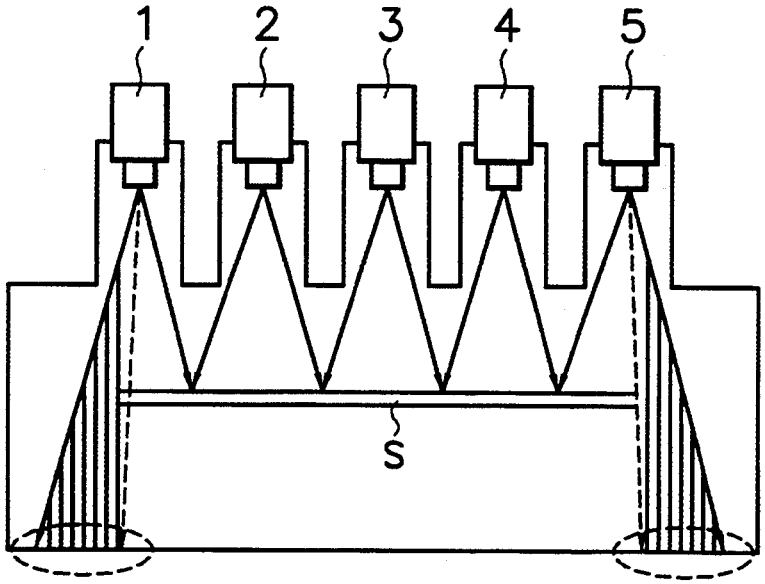
Fig. 2 PRIOR ART
FIG. 2 shows the irradiation of edge regions with electron beams in scanning electron beams according to the conventional method by utilizing a plurality of electron-beam irradiating devices.
Figure 3:
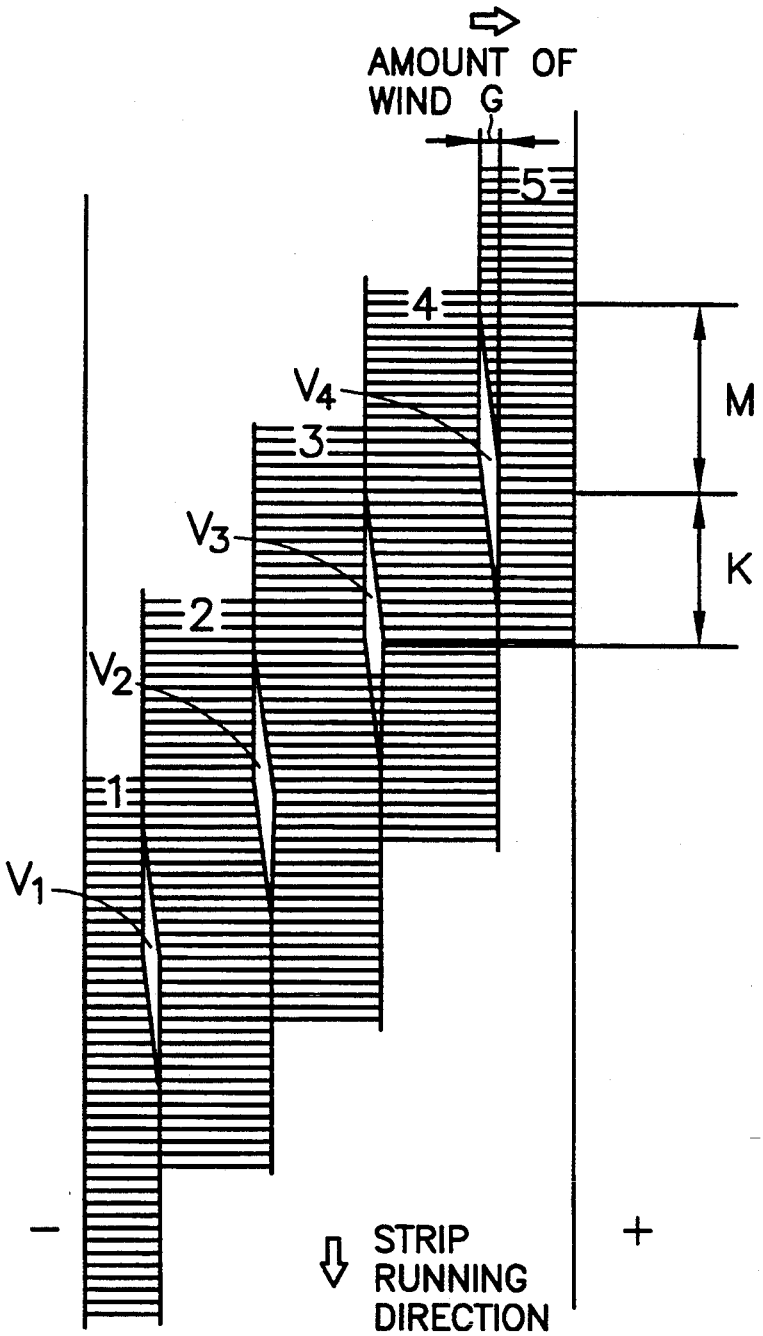
Fig. 3 PRIOR ART
FIG. 3 shows the non-irradiated portions of a strip with scanning electron beam according to the conventional method by utilizing a plurality of electron-beam irradiating devices.

It will be appreciated that the following description is intended to be directed toward specific forms of the invention selected for illustration in the drawings, and is not intended to define or to limit the scope of the invention, which is defined in the appended claims.

DESCRIPTION OF THE PREFERRED EMBODIMENTS

One embodiment of the present invention will now be described with reference to a typical example using an electron beam as the energy beam and a steel sheet as the strip.

Figure 4:
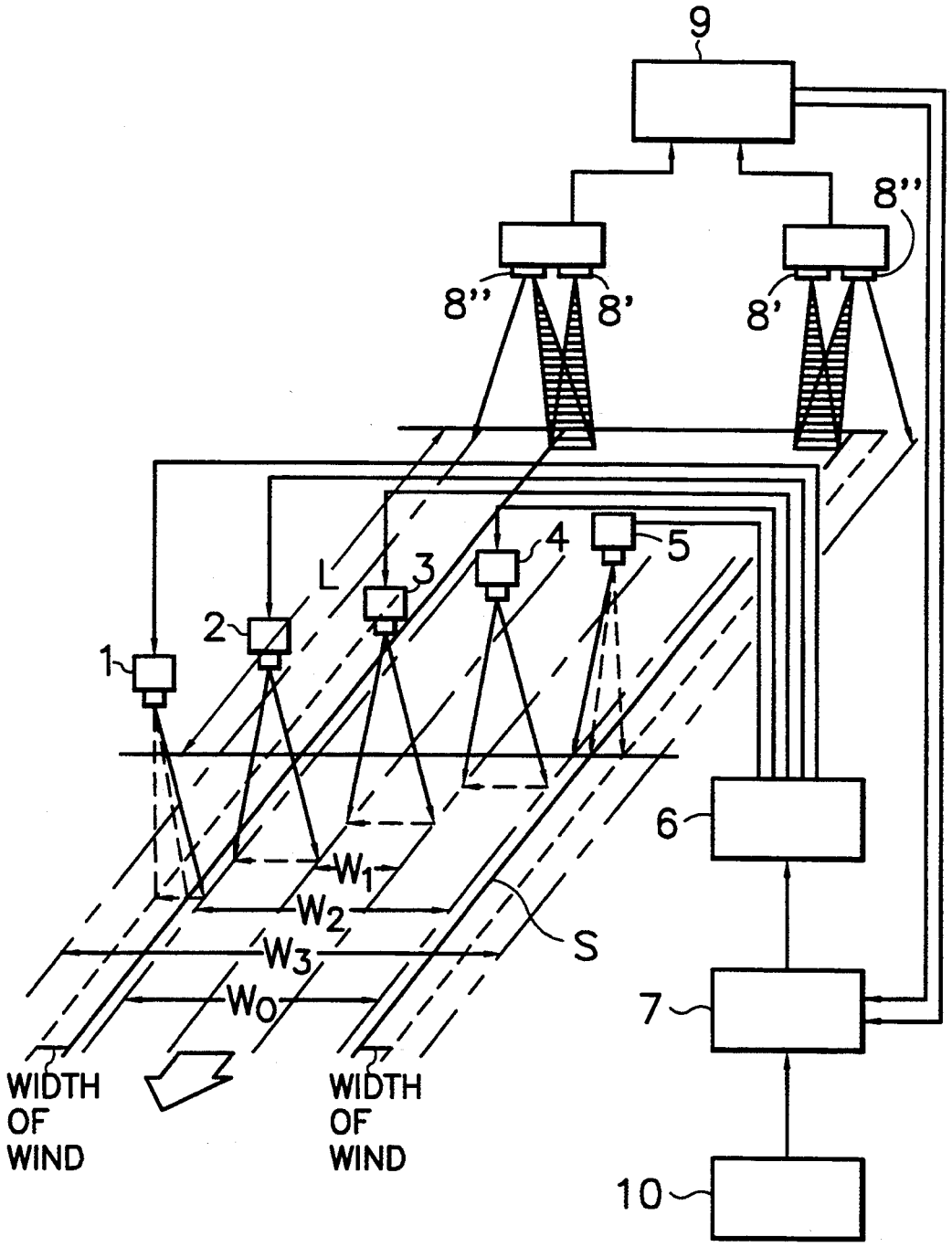
FIG. 4 shows one embodiment of electron-beam scanning according to this invention, utilizing a plurality of electron-beam irradiating devices.

FIG. 4 of the drawings shows irradiation of electron beams. It is understood that strips are welded and continuously treated as a continuous strip or sheet. Five electron-beam irradiating devices 1, 2, 3, 4 and 5 are provided in FIG. 4, though any other numbers may be used.

Since the skeleton construction of FIG. 4 is somewhat similar to that of FIG. 1, some components corresponding to FIG. 4 have been given the same reference numerals as in FIG. 1. FIG. 4 also indicates a strip-edge detecting device 8', further to be described in detail, a detecting controller 9 also to be explained in detail, and a process computer 10, the details and arrangement of which are important features. Said devices are conventional ones.

Sensed or measured data of the width W of a strip S is first transmitted to a strip driving controller 7 from the process computer 10 using electronic devices such as modem. Then, a device for irradiating with electron beams is selected in a known manner, and according to the signal from an electron beam controller 6, electron beams are scanned along selected portions of the running strip width. The strip driving controller 7 and the electron beam controller 6 are conventional devices.

The selected electron-beam irradiating devices selected from devices 1–5, as shown, are selected with respect to W as follows.

where $W \leqq W_1$: Device 3 only is energized.

where $W_1 \leqq W \leqq W_2$: Devices 2–4 are energized.

where $W_2 \leqq W \leqq W_3$: Devices 1–5 are energized.

As will be apparent, $W_1$ shows the scannable width that is applicable when only the electron-beam irradiating device 3 is to be used; $W_2$ indicates the scannable width when the electron-beam irradiating devices 2–4 are to be used; and $W_3$ represents the scannable width when the electron-beam irradiating devices 1–5 are to be used.

The strip-edge detecting devices 8' (FIG. 4) are connected and arranged for detecting the position of the strip edge in real time. It is arranged at or upstream of the electron-beam irradiating device 5, preferably as closely as possible to the device 5 (preferably, within about 10 m). A detecting signal 32 from the edge detecting device 8' is electronically connected in a manner known per se and thereby tracked by the strip driving controller 7. When the thus-detected amount of a strip wind arrives directly under the respective electron-beam irradiating devices 1–5, the scanning regions of the devices 1–5 are immediately shifted by the electron-beam controller 6 in accordance with the detected amount of the strip wind.

Figure 5A:
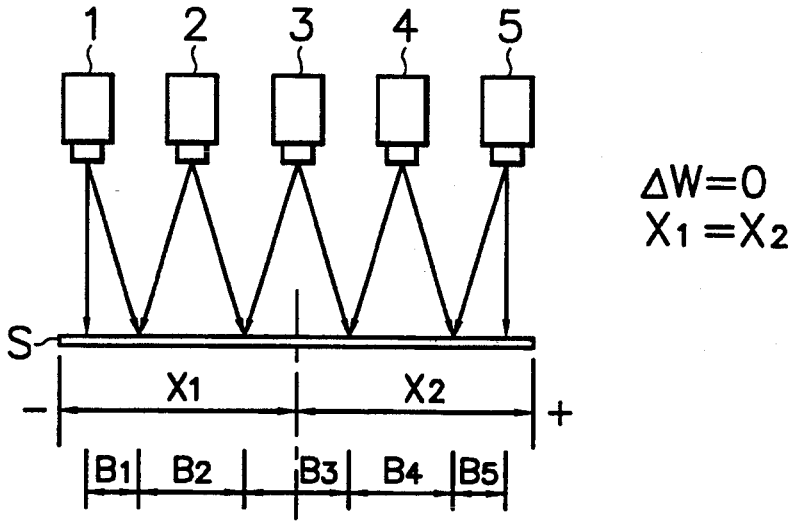
FIGS. 5(*a*), 5(*b*) and 5(*c*) show modifications of scanning regions of electron beams according to that embodiment.
Figure 5B:
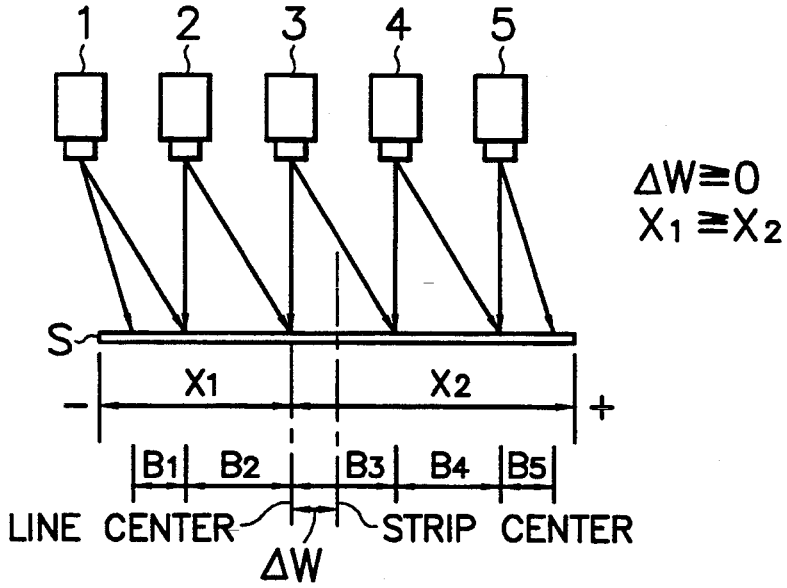
Figure 5C:
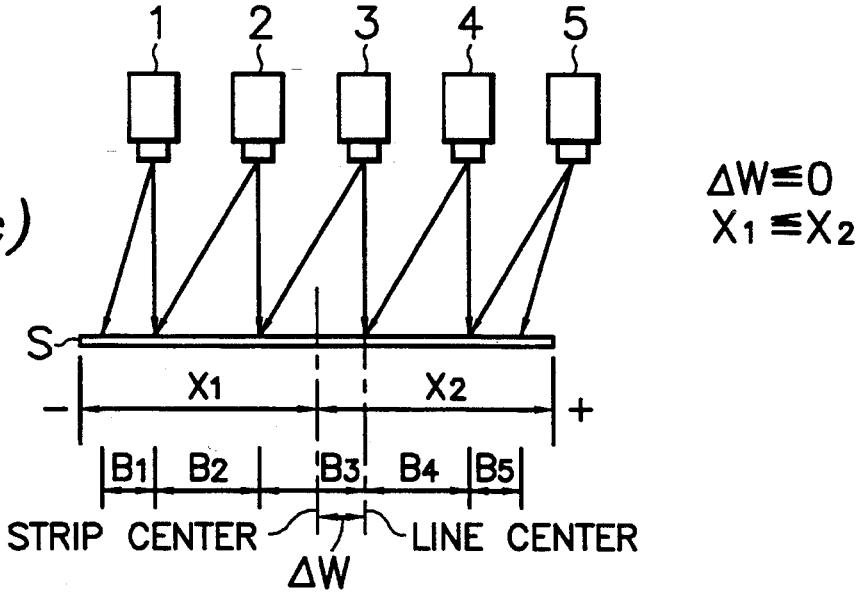

As an example, where the amount of strip wind is expressed as ΔW, as in FIGS. 5(*a*), 5(*b*) and 5(*c*), the scanning distance from the start point to the end point of the respective electron-beam irradiating devices are shifted by ΔW along the width of the strip when the detected amount of the strip wind passes by.

This phenomenon is shown in greater detail in FIGS. 5(*a*), (*b*) and (*c*). The correlation of the amount of the strip wind ΔW and the right and left edge positions $X_1$ and $X_2$ is as follows.

$$\Delta W=(X_1-X_2)/2 \quad (1)$$

When five electron-beam irradiating devices 1–5 are utilized as in FIGS. 4, 5(*a*), 5(*b*) and 5(*c*), the width of the strips is also divided into five parts, $B_1$–$B_5$ representing the regions scanned by the respective electron-beam irradiating devices. The allocations of these regions to the respective electron-beam irradiating devices may be determined in advance.

Thus, as illustrated in FIG. 5(*a*), when there is no strip wind, the respective electron-beam irradiating devices 1, 2, 3, 4 and 5 scan directly over the corresponding regions $B_1$, $B_2$, $B_3$, $B_4$ and $B_5$, respectively.

As shown in FIG. 5 (*b*), however, when a strip wind occurs on the running strip, in a direction displacing the strips by the distance ΔW toward the "+" direction (toward the right in FIG. 5(*b*)), the start point and the end point of scanning are modified so that the scanning regions of the respective electron-beam irradiating devices are shifted by a distance of ΔW toward the "+" direction in accordance with the instantaneous amount of the strip wind. As a result, the regions $B_1$–$B_5$ on the strip are still constantly scanned by the same electron-beam irradiating devices as had already been determined in advance.

Likewise, as shown in FIG. 5(*c*), when the strip S is displaced by a distance ΔW toward the "−" direction (toward the left in FIG. 5(*c*)), the scanning regions of the respective electron-beam irradiating devices 1–5 are modified by the distance ΔW toward the "−" direction, and the regions $B_1$–$B_5$ are also scanned by the same electron beam irradiating devices as were determined in advance.

The modification of the scanning regions of the electron beams is accomplished not only to the two irradiating devices 8'',8'' for irradiating the edges of the strip but to all the individual electron-beam irradiating devices 1–5, thus preventing the beams from overlapping into neighboring regions scanned by the electron beams, and avoiding any failure to irradiate other regions.

Hence, even though the electron-beam irradiating devices may be longitudinally arranged in the form of steps in accordance with another embodiment of the present invention), quick and highly accurate beam scanning can be realized without causing non-irradiated portions and without producing overlapping-irradiated portions.

In regard to the strip edges, with or without the strip wind, electron-beam irradiation can be directed to the appointed regions of the strip edges, thereby avoiding beam-irradiation of any area other than the intended area of the strip. Also, the designated regions are readily oriented to be within the limit of the edges, thereby remarkably reducing any non-irradiated portions at the edge of the strip.

In accordance with a further embodiment of the present invention, means are provided for directing irradiation even when the amount of the strip wind exceeds the scannable region of the electron-beam irradiating devices. There is particularly shogun in FIGS. 6(*a*) and 6(*b*) of the drawings.

Figure 6A:
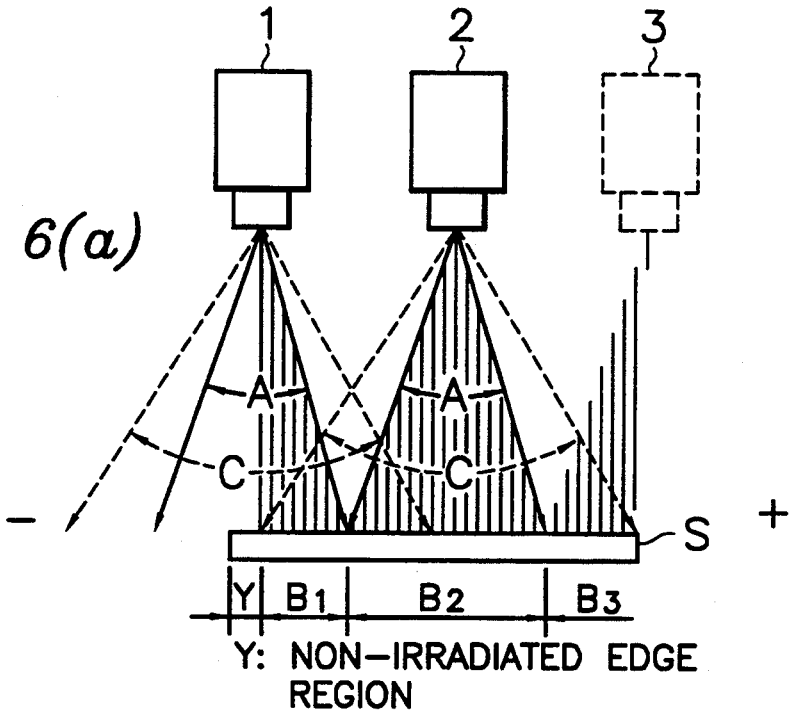
FIGS. 6(*a*) and 6(*b*) show the shifting of electron-beam irradiating devices according to still another embodiment of the present invention, with certain portions shown in dash lines.
Figure 6B:
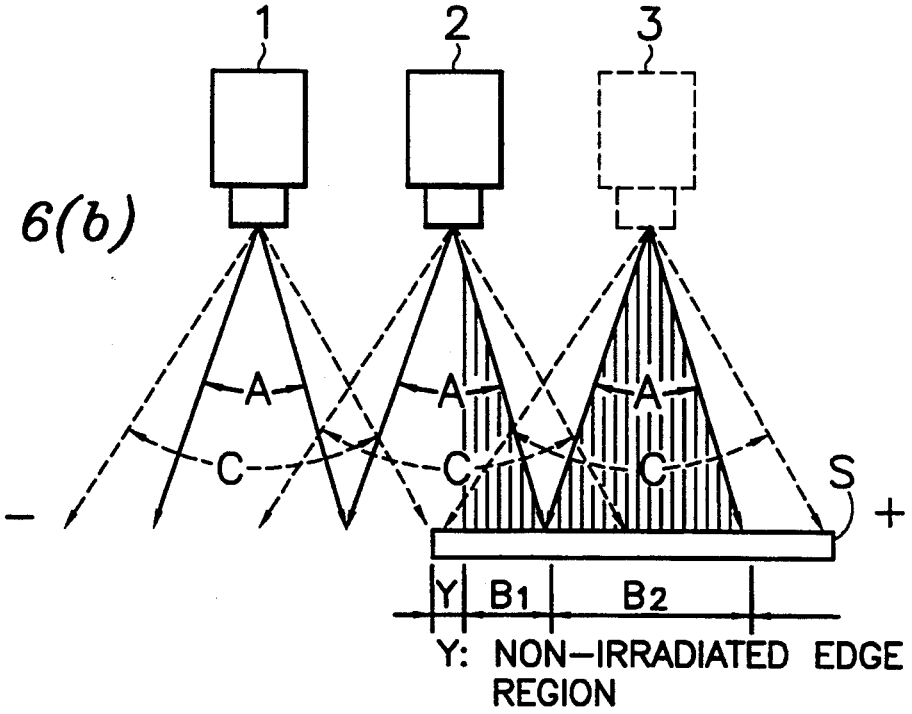

FIG. 6(*a*) shows irradiation when the amount of a wind falls within the scannable region of the electron-beam irradiating devices. En this case, as described, the respective electron-beam irradiating devices are directed to scan the predetermined corresponding strip regions allocated to the devices.

FIG. 6(*a*) indicates the actual electron-beam scanning region A and the electron-beam scannable region C.

However, a considerable or unexpected amount of strip wind sometimes occurs for some reason, and accordingly, the amount of the strip wind sometimes exceeds the scannable region of the electron-beam irradiating device.

The respective electron-beam irradiating devices for scanning predetermined regions are each shifted to the neighboring device adjacent to the scan wind, and consequently, these regions are still scanned by the shifted electron-beam irradiating device.

More specifically, as shown in FIG. 6 (*b*), when a considerable strip wind occurs toward the "+" direction, and the electron-beam irradiating device 1 cannot cover the predetermined region of the strip S, the irradiation of the electron-beam irradiating device 1 is turned off, and the region $B_1$ which has theretofore been scanned by the electron-beam irradiating device 1 before the major wind occurred is instantly scanned by the neighboring electron-beam irradiating device 2. Likewise, the regions $B_2$, $B_3$, . . . which had been scanned by the electron-beam irradiating devices 2, 3, . . . are now immediately scanned by their neighboring electron-beam devices 3 (shown in dash lines in FIG. 6(*b*) and even by further neighboring electron-beam devices, not shown.

After return to normal from the unexpectedly large strip wind, when the edge portion of strip S is returned to fall within the scannable region of the electron-beam irradiating device 1 again, the reverse operation is performed, thereby returning to normal irradiation with continuing strip wind control as heretofore described.

Accordingly, in FIGS. 6(*a*) and 6(*b*), it is necessary to set the total scannable width of the overall electron-beam irradiating devices to cover an enlarged area obtained by adding the possible maximum amount of a strip wind to the maximum width of the strip to be irradiated.

In FIGS. 6(*a*) and 6(*b*), the modifications of the electron-beam scanning regions are also made to all individual electron-beam irradiating devices, and thus, even when the electron-beam irradiating devices are longitudinally positioned or displaced to form steps, extremely fast and accurate beam scanning can be realized without permitting or causing any non-irradiated portions or producing overlapping-irradiated portions.

Although the foregoing examples have been discussed from the viewpoint of the irradiation of a steel sheet with electron beams, other kinds of strips may be irradiated with electron beams. Further, when strips including steel sheet are irradiated with laser beams or plasma beams, irradiation may readily be carried out in a manner similar to the embodiments disclosed, thus reliably obtaining the same advantages.

As will be clearly understood from the foregoing description, the present invention offers many advantages.

A strip-edge detecting device according to this invention is placed upstream of the energy-beam irradiating devices, thereby detecting the exact edge positions of the strip in real time, thus enabling energy-beam scanning in accordance with the amount of the existing wind on the strip. As a result, even though the energy-beam irradiating devices may be arranged in the form of steps, appropriate beam scanning can be realized without non-irradiated portions or overlapping-irradiated portions on the strip, thus improving the quality of the product and the yield.

In regard to the irradiation of the edge regions, the strip, except for a controllably small margin of non-irradiated regions at the strip edges, can be accurately scanned, thus preventing irradiation of beams on any area other than the desired areas of the strip and remarkably reducing the load to maintain equipment such as vacuum equipment, strip support rolls, or the like. Also, since beam-irradiation out to the edge portions, the outer limit, is possible, the amount of edge-trimming (if any) is significantly reduced, thus improving strip yield.

Although this invention has been disclosed with reference to particular forms selected for illustration, it will be appreciated that many other modifications may be made without departing from the basic idea of this invention, including the use of different kinds of strips or sheets, different kinds of radiations, and the use of certain features independently of the use of other features, all without departing from the basic idea and scope of this invention, as defined in the appended claims.

What is claimed is:

1. In a method of irradiating a continuously-running strip with a plurality of energy-beam irradiating devices positioned along the width of said strip, each said device being oriented to a designated scanning region on said strip, said method comprising the steps of:

(a) allocating selected scanning regions along the width of said strip, each to receive the energy-beam from a corresponding one of said respective energy-beam irradiating devices; and (b) detecting, at a location upstream of said energy-beam irradiating devices, the amount of a deviation of the position of a strip edge in real time; and (c) modifying said selected regions scanned by said respective energy-beam irradiating devices in response to the amount of said deviation of said position of said strip, thereby continuously scanning said selected regions on said strip by said scanned energy-beam irradiating devices.

2. A method of irradiating a continuously-running strip with energy beams wherein energy-beam irradiation is achieved by scanning along the width of said strip on said continuously-running strip by utilizing a plurality of designated energy-beam irradiating devices installed to cover the width of said strip; said method comprising the steps of:

determining in advance a plurality of designated scanning regions arranged along the width of said strip, each to receive the energy-beam from said respective energy-beam irradiating devices;

placing detecting means at a location upstream of said energy-beam irradiating devices;

detecting the amount of a deviation of edge portion of said strip in real time;

shifting the orientation of said energy-beams of said energy-beam irradiating devices in response to the amount of said deviation of said edge portion of said strip;

providing irradiating means for operating and effecting said designated energy-beam irradiating devices for scanning scannable regions;

activating said irradiating means when said strip edge portion deviation exceeds the scannable regions scanned by said designated energy-beam irradiating devices; and scanning by said additional energy-beam irradiating devices.

3. A method of irradiating a running strip with energy beams according to either one of claims 1 and 2, wherein said plurality of energy-beam irradiating devices are arranged in a stepwise means to apply energy obliquely longitudinally cross said strip.

4. A method of irradiating a running strip with energy beams according to either one of claims 1 and 2, wherein said energy beam is selected from the group consisting of electron beams, laser beams and plasma beams.

* * * * *